US010081952B2

(12) United States Patent
Bowers

(10) Patent No.: US 10,081,952 B2
(45) Date of Patent: Sep. 25, 2018

(54) SYSTEM AND METHOD FOR INTERLOCKING SECTIONS OF ATHLETIC AND/OR PROTECTIVE SURFACE MATS

(71) Applicant: Resilite Sports Products, Inc., Sunbury, PA (US)

(72) Inventor: Timothy Bowers, Milton, PA (US)

(73) Assignee: RESILITE SPORTS PRODUCTS, INC., Sunbury, PA (US)

( * ) Notice: Subject to any disclaimer, the term of this patent is extended or adjusted under 35 U.S.C. 154(b) by 501 days.

(21) Appl. No.: 14/687,373

(22) Filed: Apr. 15, 2015

(65) Prior Publication Data

US 2016/0047129 A1 Feb. 18, 2016

Related U.S. Application Data

(60) Provisional application No. 62/036,706, filed on Aug. 13, 2014.

(51) Int. Cl.

| | |
|---|---|
| ***E04F 15/22*** | (2006.01) |
| ***E04F 15/02*** | (2006.01) |
| ***A63B 6/00*** | (2006.01) |
| *A63B 21/00* | (2006.01) |

(52) U.S. Cl.

CPC ..... *E04F 15/22* (2013.01); *A63B 6/00* (2013.01); *E04F 15/02038* (2013.01); *A63B 21/4037* (2015.10); *E04F 2201/0138* (2013.01)

(58) Field of Classification Search

CPC ... A63B 21/4037; A63B 6/00; A63B 21/4035; A63B 2210/50; A47G 9/062; A47G 9/06; E04F 13/0894; E04F 15/02; E04F 15/02016; E04F 15/02022; E04F 15/02038; E04F 15/02177; E04F 15/22; E04F 2201/0146; E04F 2201/044

USPC ..... 5/420, 417, 722, 723; 482/23, 142; 52/309.1, 384, 578, 579, 588.1, 582.1, 52/582.2, 584.1

See application file for complete search history.

(56) References Cited

U.S. PATENT DOCUMENTS 3,242,509 A * 3/1966 Nissen ..... A63B 6/00 273/DIG. 4
3,284,819 A * 11/1966 Nissen ..... A47C 27/001 297/378.1
3,319,273 A * 5/1967 Solin ..... A63B 6/00 24/432

(Continued)

*Primary Examiner* — Robert G Santos
(74) *Attorney, Agent, or Firm* — Epstein Drangel LLP; Robert L. Epstein

(57) ABSTRACT

First and second mat sections are interlocked using a resilient closure strip. A layer of reinforced vinyl scrim is situated on the surface of each mat section. The closure includes two closure members each having an interengaging portion and a connecting portion. The connecting portion of one closure member is mounted on one mat section with the interengaging portion in a given orientation. The connecting portion of the other closure member is mounted on the other mat section with the interengaging portion thereof in an orientation opposite to that of the first interengaging portion with at least a portion thereof extending beyond the mat surface such that the interengaging portions align and can be interengaged by a downward force when the mat sections are situated in side-by-side relation. A coating of poly-vinyl paint is situated over each of the closure members and the reinforced vinyl scrim layer.

15 Claims, 3 Drawing Sheets

(56) References Cited

U.S. PATENT DOCUMENTS 3,526,911 A * 9/1970 Meyer et al. ..... A63C 19/04 428/33
3,624,848 A * 12/1971 Nissen ..... A63B 6/00 5/420
3,694,983 A * 10/1972 Couquet ..... B29C 70/78 404/40
3,918,233 A * 11/1975 Simpson ..... E04B 7/105 52/536
3,935,682 A * 2/1976 Simpson ..... A44B 19/16 52/105
4,078,351 A * 3/1978 Simpson ..... E04B 7/105 52/462
4,296,582 A * 10/1981 Simpson ..... E04C 2/526 52/592.1
4,350,721 A * 9/1982 Nagase ..... A44B 19/34 160/DIG. 18
5,093,169 A * 3/1992 Sakuraba ..... A63C 19/04 428/33
6,588,166 B2 * 7/2003 Martensson ..... E04B 1/6129 403/364
6,606,834 B2 * 8/2003 Martensson ..... E04B 1/6129 52/578
7,131,242 B2 * 11/2006 Martensson ..... E04B 1/6129 52/578
7,497,058 B2 * 3/2009 Martensson ..... E04B 1/6129 52/582.1
7,797,899 B2 * 9/2010 Linn ..... E04B 1/355 52/273
7,856,784 B2 * 12/2010 Martensson ..... E04B 1/6129 52/582.1
8,029,426 B2 * 10/2011 Sohn ..... A63B 23/0211 482/140
8,276,342 B2 * 10/2012 Martensson ..... E04B 1/6129 52/582.1
8,307,600 B2 * 11/2012 Heartsfield ..... E04F 15/02 52/177
8,402,709 B2 * 3/2013 Martensson ..... E04B 1/6129 52/582.1
8,596,011 B2 * 12/2013 Heartsfield ..... E04F 15/02 52/582.1
8,661,762 B2 * 3/2014 Martensson ..... E04B 1/6129 52/586.1
8,733,056 B2 * 5/2014 Heartsfield ..... A63B 6/00 482/23
8,800,233 B1 * 8/2014 Heartsfield ..... A63B 6/00 482/23
8,875,465 B2 * 11/2014 Martensson ..... E04B 1/6129 52/582.1
9,032,685 B2 * 5/2015 Martensson ..... E04B 1/6129 52/591.1
9,278,243 B1 * 3/2016 Heartsfield ..... A63B 6/00
2001/0034991 A1 * 11/2001 Martensson ..... E04B 1/6129 52/578
2002/0152707 A1 * 10/2002 Martensson ..... E04B 5/12 52/584.1
2002/0178680 A1 * 12/2002 Martensson ..... E04D 1/26 52/518
2004/0035077 A1 * 2/2004 Martensson ..... E04B 1/6129 52/578
2006/0248836 A1 * 11/2006 Martensson ..... E04B 1/6129 52/588.1
2009/0038253 A1 * 2/2009 Martensson ..... E04B 1/6129 52/582.1
2009/0145070 A1 * 6/2009 Linn ..... E04B 1/355 52/465
2010/0323862 A1 * 12/2010 Sohn ..... A63B 23/0211 482/145
2011/0003110 A1 * 1/2011 Heartsfield ..... E04F 15/02 428/99
2011/0185663 A1 * 8/2011 Martensson ..... E04B 1/6129 52/309.13
2012/0216472 A1 * 8/2012 Martensson ..... E04B 1/6129 52/302.1
2013/0019456 A1 * 1/2013 Heartsfield ..... A63B 6/00 29/525.03
2013/0042555 A1 * 2/2013 Martensson ..... E04B 1/6129 52/309.1
2013/0055533 A1 * 3/2013 Heartsfield ..... E04F 15/02 24/301
2013/0067840 A1 * 3/2013 Martensson ..... E04B 1/6129 52/309.1
2016/0047129 A1 * 2/2016 Bowers ..... E04F 15/22 16/16

* cited by examiner

SYSTEM AND METHOD FOR INTERLOCKING SECTIONS OF ATHLETIC AND/OR PROTECTIVE SURFACE MATS

BACKGROUND OF THE INVENTION

1. Field of the Invention

This invention relates to athletic and/or protective surface mats for participating in various activities including wrestling, martial arts, tumbling and cheerleading, which may take the form of wrestling mats, training mats, tumbling mats and carpet, and more particularly, a system and method of interlocking sections of such mats.

2. Description of Prior Art Including Information Disclosed Under 37 CFR 1.97 and 1.98

Participants in athletic activities use mats for protection. If the mat is provided in multiple sections, as it often is for easy storage and shipping, the sections need to be connected together before use. The standard connecting devices used for this purpose have been tape and hook and loop fastener strips (i.e. Velcro®).

However, tape is expensive and must be replaced regularly. Hook and loop strips are not easy to clean, do not lay flat and form an abrasive edge along the sides of the mat sections which the hook and loop strips attach together. Further, connecting and disconnecting both tape and hook and loop strips cause stress on the mat surface.

Accordingly, there is a need for a system and method of interlocking sections of athletic or other protective surface mats which forms a continuing connecting surface which is resilient and which attaches the mat sections to each other securely but which permits the mat sections to be easily and quickly attached together and detached from each other. Further, the interlocking closure should permit easy cleaning and create a seal which prevents liquids and particulate matter from being received between the sides of the interlocked mat sections. The system should be relatively inexpensive to fabricate and mount securely to the mat sections. It should also permit the mat sections to be connected together using a roller or similar mechanical pressure applying device.

SUMMARY OF THE INVENTION

The present invention employs a zipper-type or rubber/plastic snap strip type closure device to interlock the sides of the mat sections together. The closure device creates a continuous surface across the top of the mats. It is fabricated of smooth, resilient material so as to create a surface similar to the surface of the mat sections. The closure device can extend either horizontally or vertically along the top surface or side surface of the mat section. The closure device is liquid proof and prevents spills and other materials from penetrating below the surface of the closure sections. Further, the closure is easily cleaned because it is liquid proof.

The mats can be fabricated to have a foam or protective core, (such as rubber nitrile foam, polyethylene foam, or other types of resilient material) and can be formed of a single or multiple layers. The surface of the mat can be vinyl, carpet or any other suitable resilient surface. The connecting device may have a relief channel.

The preferred embodiment of the present invention is disclosed herein as employing a MaxiGrip® plastic zipper-type closure available from ITW MaxiGrip of Somerset, N.J. to interlock the mat sections. However, other zipper-type plastic closures available from other sources may function adequately as well.

In accordance with one aspect of the present invention, a system is provided for interlocking first and second mat sections. The system includes a resilient closure strip fir interlocking the mats sections. Each of the mat sections has a surface. A layer of reinforced vinyl scrim is situated on the surface of each of the mat sections. The closure strip includes first and second closure members. Each of the closure members has an interengaging portion and a substantially planar connecting portion. The connecting portion of the first closure member is mounted on the first mat section with the interengaging portion thereof in a given orientation. The connecting portion of the second closure member is mounted on the second mat section with the interengaging portion thereof in an orientation substantially opposite to the orientation of the interengaging portion of the first closure member. At least a portion of the interengaging portion of the second closure member extends beyond the surface such that the interengaging portions of the first and second closure members align and can be interengaged when the mat sections are situated in side-by-side relation. A coating of poly-vinyl paint is situated over said first and second closure members and said reinforced vinyl scrim layer.

The system also includes a hand-held roller adapted to apply a downward force on the aligned interengaging portions to interengage the interengaging portions.

In accordance with another aspect of the present invention, a method is provided for interlocking first and second mat sections using a resilient closure strip including first and second closure members, each of the closure members having an interengaging portion and a connecting portion. The method includes the steps of: applying a layer of reinforced vinyl scrim on a surface of each of the mat sections mounting the connecting portion of the first closure member on the surface of the first mat section with the interengaging portion thereof in a given orientation; mounting the connecting portion of the second closure member on the surface of the second mat section with the interengaging portion thereof in an orientation substantially opposite to the orientation of the interengaging portion of the first closure member and at least a portion of the interengaging portion thereof extending beyond the surface to which the second closure member is mounted; locating the first and second mat sections in side-by-side relation such that the interengaging portions of the first and second closure members align; applying a downward force on the aligned interengaging portions of the first and second closure members causing the aligned interengaging portions interengage to interlock the first and second mat sections; and coating the first and second closure members and the reinforced vinyl scrim layer on the surface of each of the first and second mat sections with poly-vinyl paint.

The method also includes applying a downward force on the aligned interengaging portions using a hand-held roller.

It is a prime object of the present invention to provide a system and method of interlocking sections of athletic or other protective surface mats.

It is another object of the present invention to provide a system and method of interlocking sections of athletic or other protective surface mats which forms a continuing connecting surface.

It is another object of the present invention to provide a system and method of interlocking sections of athletic or other protective surface mats that will form a resilient connecting surface.

It is another object of the present invention to provide a system and method of interlocking sections of athletic or other protective surface mats that will attach the sections securely.

It is another object of the present invention to provide a system and method of interlocking sections of athletic or other protective surface mats which permits easy cleaning.

It is another object of the present invention to provide a system and of interlocking sections of athletic or other protective surface mats that permits the sections to be easily and quickly attached together and detached from each other.

It is another object of the present invention to provide a system and method of interlocking sections of athletic or other protective surface mats which is relatively inexpensive to fabricate and mount securely to the mat sections.

It is another object of the present invention to provide a system and method of interlocking sections of athletic or other protective surface mats which permits the mats to be connected together using a roller or similar mechanical pressure applying device.

BRIEF DESCRIPTION OF THE SEVERAL VIEWS OF DRAWINGS

To these and to such other objects that may hereinafter appears, the present invention relates to a system and method for interlocking athletic or other protective surface mats as described in detail in the following specification and recited in the annexed claims, taken together with the accompanying drawings, in which like numerals refer to like parts and in which:

DETAILED DESCRIPTION OF THE INVENTION

Figure 1:
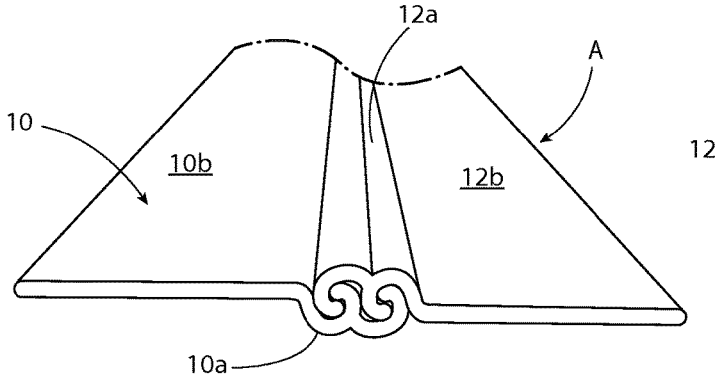
FIG. 1 is a perspective view of the closure members interengaged.

As depicted in FIG. 1, the present invention employs a zipper-type or rubber/plastic snap-type strip closure, generally designated A. Closure A includes two closure members 10, 12, each formed of smooth, resilient material.

Each closure member includes an interengaging portion 10*a*, 12*a*, and a generally planar connecting portion 10*b*, 12*b* extending outwardly from the interengaging portion. Preferably, the interengaging portion and the connecting portion of each closure member are integral and extruded or otherwise formed together as a single piece.

The present invention is illustrated with a MaxiGrip® plastic zipper-type closure available from ITW MaxiGrip of Somerset, N.J. to interlock the mat sections. However, other zipper-type or snap type resilient closures may function adequately as well.

Figure 2:
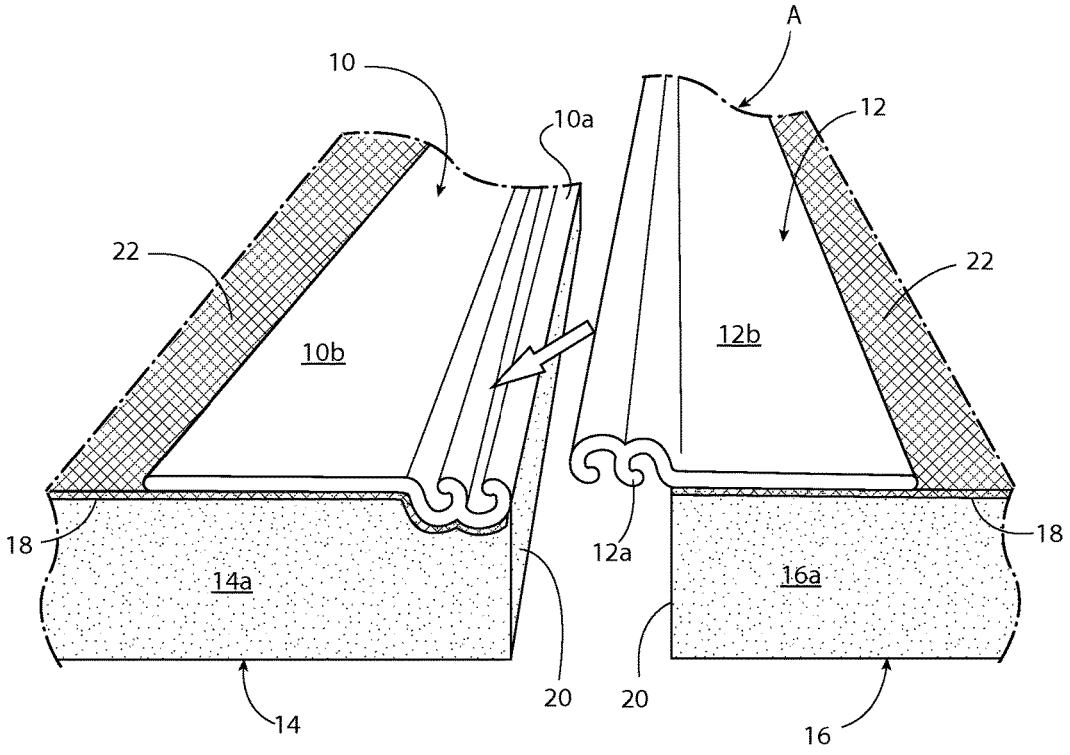
FIG. 2 is a perspective view showing sections of the mats with the scrim layer on the top surface and the mounted closure members prior to the closure members being interengaged.
Figure 3:
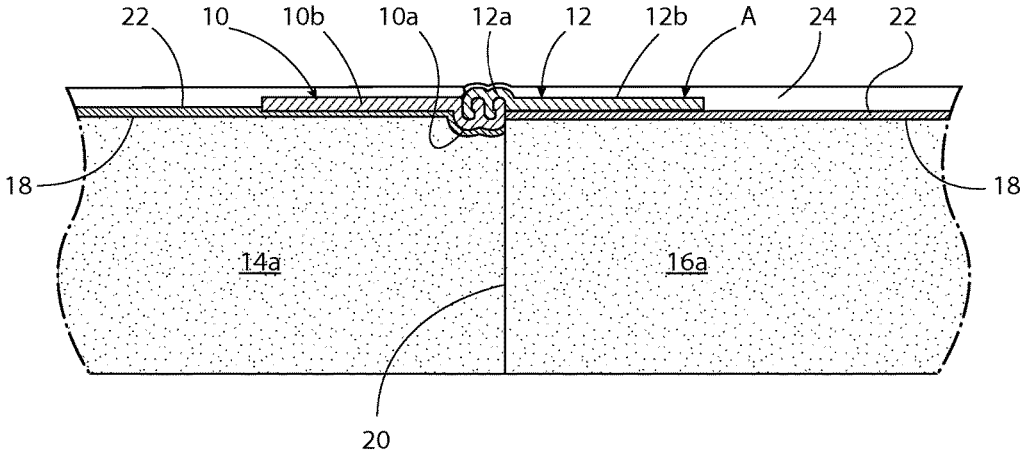
FIG. 3 is a sectional view of the mat sections with the closure members interengaged.

Closure members 10, 12 are oppositely oriented and mounted to the top of mat sections 14, 16, respectively. When properly aligned, the interengaging portions 10*b*, 12*b* of the closure members can be engaged, as seen in FIG. 2, to interlock the mat sections 14, 16 together in side-by side relation, as seen in FIG. 3.

When the closure members 10, 12 are interengaged, the closure creates a substantially continuous surface across the top of the interlocked mat sections 14, 16. The closure members are fabricated so as to provide a surface similar to the top surface of the mat sections 14, 16.

Closure A can extend either horizontally along the top surface 18 of the mat sections (as illustrated) or vertically along the side surfaces 20 of the mat sections. When the closure members are interengaged, liquid proof seal is created which prevents spills of liquid and particulate materials from penetrating below the surface of the closure and entering between the sides 20 of the interlocked mat sections 14, 16. The closure can be easily cleaned because it is liquid proof.

Mat sections 14, 16 can be fabricated to have a foam or protective core, (such as rubber nitrile foam, polyethylene foam, or other types of resilient material) and can be formed of a single or multiple layers. Each mat section 14, 16 includes a body 14*a*, 14*b* with a top surface 18 and a side surface 20. A thin layer of reinforced scrim 22 is applied to the top surface 18 of each of the mat section.

The bottom surface of the connecting portion 10*b* of closure member 10 is fixed to the scrim layer 22 on the top surface 18 of mat section 14 to secure the closure member to the mat section. Similarly, the bottom surface of connecting portion 12*b* of closure member 12 is fixed to the scrim layer 22 on top surface 18 of mat section 16 to secure the closure member to the mat section.

The connecting portions of the closure members are permanently fixed to the scrim layer on top of the respective mat sections. This can be accomplished by sonic welding, adhesive or other conventional method which does not adversely affect the materials of which the closure members, scrim layer and mat sections are made.

As best seen in FIG. 2, each of the closure members 10, 12 creates a slight depression in the underlying resilient mat section material when mounted on the mat section. This permits the top surface of the interlocked mats to be substantially continuous, as illustrated in FIG. 3.

Further, closure member 10 is positioned relative to mat section 14 such that the unattached side of interengaging portion 10*a* of closure member 10 is substantially coextensive with the plane of side surface 20 of mat section 14. By way of contrast, closure member 12 is positioned relative to mat section 16 such that interengaging portion 12*a* of closure member 12 extends beyond the plane of side surface 20 of mat section 16. This permits the interengaging portions 10*a*, 12*a* to align when the mat sections 14, 16 are placed in side-by-side relation.

Preferably, a continuous coating 24 of poly-vinyl paint is provided over the exposed surface of each of the closure members 10, 12 and the reinforce vinyl scrim layer 22 of the mat sections. Coating 24 may be applied before or after the mat sections are interlocked. Coating 24 is preferably sprayed onto the surfaces to provide a thin, uniform, protective layer.

As noted previously, closure members 10, 12 are mounted on mat sections 14, 16 in opposite orientations and are located on the mat sections such that interengaging portions 10*a*, 12*a* are aligned when the mat sections are in side-by-side relation. That permits the mat sections to be interlocked by simply applying a downward force on the interengaging portions from above.

Figure 4:
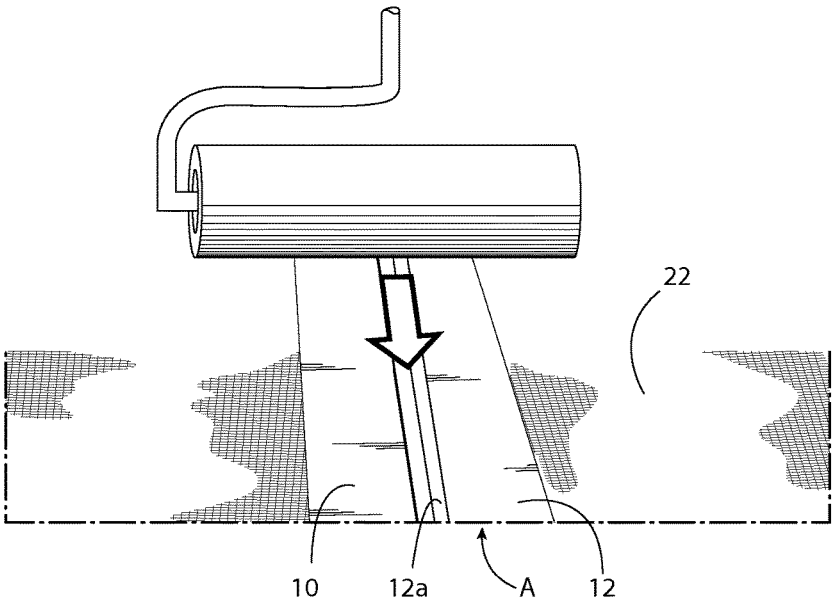
FIG. 4 is a perspective view of the closure members being interengaged by a roller.
Figure 5:
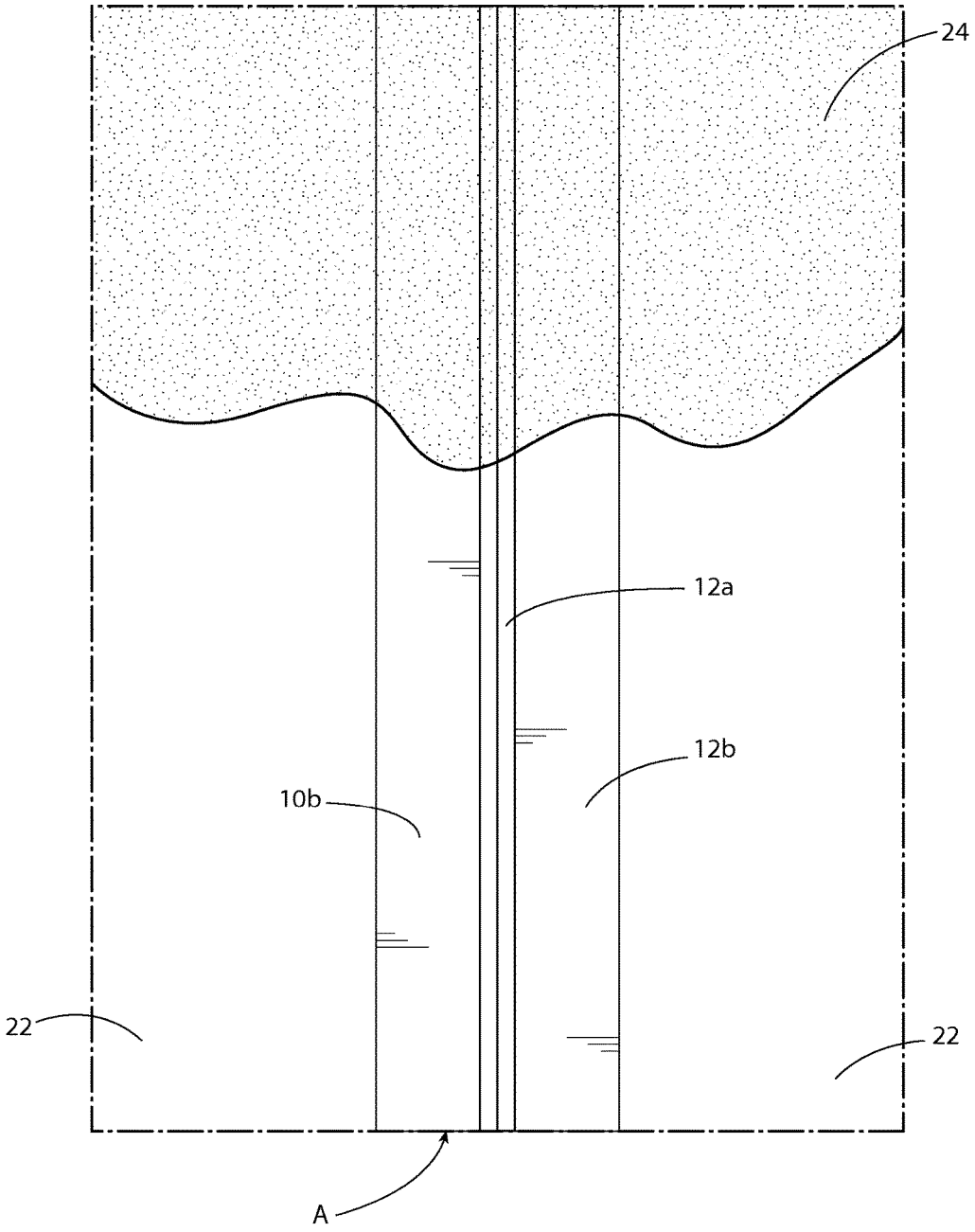
FIG. 5 is an elevation view of interlocked mat sections showing the paint layer.

While the downward interlocking force could be applied manually to interengage the closure members, a hand-held roller, such as illustrated in FIG. 4 has been found to facilitate the interlocking process and substantially reduce the time necessary to interlock the mat sections.

The interlocked mat sections can be detached by pulling mat section 16 upwardly relative to mat section 14 such that interengaging portion 12*a* is no longer interengaged with interengaging portion 10*a*. However, as long as the interengaging portions of the closure members are interengaged, a secure, liquid sealed connection is maintained between the mat sections and there is a substantially continuous smooth surface created by the interlocked mat sections.

In use, the first and second mat sections are interlocked using a resilient closure strip including first and second closure members, each of the closure members having an interengaging portion and a connecting portion. A layer of reinforced vinyl scrim is applied on a surface of each of the mat sections. The connecting portion of the first closure member is mounted on the surface of the first mat section with the interengaging portion thereof in a given orientation. The connecting portion of the second closure member is mounted on the surface of the second mat section with the interengaging portion thereof in an orientation substantially opposite to the orientation of the interengaging portion of the first closure member. At least a portion of the interengaging portion of the second closure member extends beyond the surface to which the second closure member is mounted. The first and second mat sections are located in side-by-side relation such that the interengaging portions of the first and second closure members align. A downward force is applied on the aligned interengaging portions of the first and second closure members causing the aligned interengaging portions interengage to interlock the first and second mat sections. The first and second closure members and the reinforced vinyl scrim layer on the surface of each of the first and second mat sections are coated with poly-vinyl paint.

In the preferred embodiment, the downward force is applied on the aligned interengaging portions using a hand-held roller.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims.

I claim:

1. A method for interlocking first and second mat sections, each having a top surface and an edge, using a resilient closure strip including first and second closure members, each of the closure members including an interengaging portion and a connecting portion, the method comprising the steps of:

(a) applying a layer of reinforced vinyl scrim on a top surface of each of the mat sections;

(b) situating the first closure member over the top surface of the first mat section with the interengaging portion thereof in a given orientation and situated proximate to the edge of the top surface of the first mat section;

(c) situating the connecting portion of the second closure member over the top surface of the second mat section with the interengaging portion thereof in an orientation substantially opposite to the orientation of the interengaging portion of the first closure member and at least a portion of the interengaging portion thereof extending beyond the top surface to which the second closure member is mounted;

(d) wherein the first closure member creates a depression in the underlying first mat section such that the top surface of the first mat section and the top surface of the second mat section are substantially continuous when said first mat section and said second mat section are interlocked;

(e) locating the first and second mat sections in side-by-side relation such that the interengaging portions of the first and second closure members align (f) applying a downward force on the aligned interengaging portions of the first and second closure members causing the aligned interengaging portions to interengage to interlock the first and second mat sections; and (g) coating the first and second closure members and the reinforced vinyl scrim layer on the top surface of each of the first and second mat sections with poly-vinyl paint.

2. The method of claim 1 wherein the step of applying a downward force on the aligned interengaging portions comprises the step of using a hand-held roller to apply the downward force.

3. A method for interlocking first and second mat sections using a hand-held roller, each mat section having a top surface and an edge, and a resilient closure strip including first and second closure members, each of the closure members including an interengaging portion and a substantially planar connecting portion, the method comprising the steps of:

(a) applying a layer of reinforced vinyl scrim on the top surface of each of the first and second mat sections;

(b) mounting the first closure member over the top surface of the first mat section with the interengaging portion thereof in a given orientation and situated proximate to the edge of the top surface of the first mat section;

(c) mounting the connecting portion of the second closure member over the top surface of the second mat section with the interengaging portion thereof in an orientation substantially opposite to the orientation of the interengaging portion of the first closure member and at least a portion of the interengaging portion thereof extending beyond the top surface to which the second closure member is mounted;

(d) wherein the first closure member creates a depression in the underlying first mat section such that the top surface of the first mat section and the top surface of the second mat section are substantially continuous when said first mat section and said second mat section are interlocked;

(e) locating the first and second mat sections in side-by-side relation such that the interengaging portions of the first and second closure members align;

(f) using the hand-held roller to apply a downward force on the aligned interengaging portions of the first and second closure members so as to cause the aligned interengaging portions to interengage the first and second mat sections; and (g) coating the first and second closure members and the reinforced vinyl scrim layer with poly-vinyl paint.

4. A system for interlocking first and second mat sections, said system comprising a resilient closure strip for interlocking said first and second mat sections, each of the mat sections having a top surface with an edge, a layer of reinforced vinyl scrim situated on the top surface of each of the first and second mat sections, each of said closure members comprising an interengaging portion and a connecting portion, said connecting portion of said first closure member being situated over said scrim layer on the top surface of the first mat section with said interengaging portion thereof in a given orientation and situated proximate to the edge of the top surface of the first mat section, said connecting portion of said second closure member being situated over said scrim layer on the top surface of the second mat section with said interengaging portion thereof in an orientation substantially opposite to said given orientation with at least a portion of said interengaging portion thereof extending beyond the top surface of said second mat section such that the interengaging portions of said first and second closure members align and can be interengaged when said mat sections are situated in side-by-side relation, wherein the first closure member creates a depression in the underlying first mat section such that the top surface of the first mat section and the top surface of the second mat section substantially continuous when said first mat section and said second mat section are interlocked and a coating of poly-vinyl paint situated over said first and second closure members and said reinforced vinyl scrim layer.

5. The system of claim 4 further comprising a hand-held roller adapted to apply a downward force on said aligned interengaging portions to interengage said interengaging portions.

6. The system of claim 4 further comprising a layer of reinforced scrim situated between the top surface of each mat section and the connecting portion of the closure member situated over that mat section.

7. A system for interlocking first and second mat sections, said system comprising a resilient closure strip for interlocking said first and second mat sections, each of the mat sections having a top surface with an edge, said closure strip comprising first and second closure members, each of said closure members comprising an interengaging portion and a connecting portion, said connecting portion of said first closure member being situated over the top surface of the first mat section with said interengaging portion thereof in a given orientation and situated over a section of the top surface of the first mat section proximate the edge of the first mat section, said connecting portion of said second closure member being situated over the second mat section with said interengaging portion thereof in an orientation substantially opposite to said given orientation with at least a portion of said interengaging portion thereof extending beyond the top surface of said second mat section such that the interengaging portions of said first and second closure members align and can be interengaged when said mat sections are situated in side-by-side relation, wherein the first closure member creates a depression in the underlying first mat section such that the top surface of the first mat section and the top surface of the second mat section are substantially continuous when said first mat section and said second mat section are interlocked.

8. The system of claim 7 further comprising a coating of poly-vinyl paint over the closure members.

9. A method for interlocking first and second mat sections, each having a top surface and an edge, using a resilient closure strip including first and second closure members, each of the closure members including an interengaging portion and a connecting portion, the method comprising the steps of:

(a) situating the connecting portion of the first closure member over the top surface of the first mat section with the interengaging portion thereof in a given orientation;

(b) situating the connecting portion of the second closure member over the top surface of the second mat section with the interengaging portion thereof in an orientation substantially opposite to the orientation of the interengaging portion of the first closure member;

(c) locating the first and second mat sections in side-by-side relation such that the interengaging portions of the first and second closure members align; and (d) applying a downward force on the aligned interengaging portions of the first and second closure members causing the aligned interengaging portions to interengage to interlock the first and second mat sections wherein the first closure member creates a depression in the underlying first mat section such that the top surface of the first mat section and the top surface of the second mat section are substantially continuous when said first mat section and said second mat section are interlocked.

10. The method of claim 9 further comprising the step of applying a layer of reinforced scrim over the top surface of each mat section prior to situating the connecting portions of the closure members over the mat sections.

11. The method of claim 9 further comprising the step of applying a coating of poly-vinyl paint over the closure members.

12. In combination, first and second mat sections and a system for interlocking said first and second mat sections, said mat sections each having a top surface and an edge, the interlocking system comprising a resilient closure strip for interlocking said first and second mat sections, said closure strip comprising first and second closure members, each of said closure members comprising an interengaging portion and a connecting portion, said connecting portion of first closure member being situated over the top surface of the first mat section with said interengaging portion thereof in a given orientation, said connecting portion of said second closure member being situated over the second mat section with said interengaging portion thereof in an orientation substantially opposite to said given orientation, such that the interengaging portions of said first and second closure members align and can be interengaged when said mat sections are situated in side-by-side relation, wherein the first closure member creates a depression in the underlying first mat section such that the top surface of the first mat section and the top surface of the second mat section are substantially continuous when said first mat section and said second mat section are interlocked.

13. The combination of claim 12 wherein said system further comprising a layer of reinforced scrim situated between the top surface of each mat section and the connecting portion of the closure member situated over that mat section.

14. The combination of claim 12 wherein said system further comprises a coating of poly-vinyl paint over the closure members.

15. In combination, first and second mat sections, each of the mat sections having a top surface with an edge, and a system for interlocking said first and second mat sections, said system comprising a resilient closure strip, a layer of reinforced vinyl scrim situated on the top surface of each of the first and second mat sections, said closure strip comprising first and second closure members, each of said closure members comprising an interengaging portion and a connecting portion, said connecting portion of first closure member being situated over said scrim layer on the top surface of the first mat section with said interengaging portion thereof in a given orientation and situated proximate to the edge of said top surface of the first mat section, said connecting portion of said second closure member being situated over said scrim layer on the top surface of the second mat section with said interengaging portion thereof in an orientation substantially opposite to said given orientation with at least a portion of said interengaging portion thereof extending beyond the top surface of said second mat section such that the interengaging portions of said first and second closure members align and can be interengaged when said mat sections are situated in side-by-side relation, wherein the first closure member creates a depression in the underlying first mat section such that the top surface of the first mat section and the top surface of the second mat section are substantially continuous when said first mat section and said second mat section are interlocked and a coating of poly-vinyl paint situated over said first and second closure members and said reinforced vinyl scrim layer.

* * * * *